US007082884B2

(12) United States Patent
Tajima et al.

(10) Patent No.: US 7,082,884 B2
(45) Date of Patent: Aug. 1, 2006

(54) SEQUIN FEEDER

(75) Inventors: Ikuo Tajima, Kasugai (JP); Satoru Suzuki, Kasugai (JP); Kenji Suzuki, Kasugai (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 10/535,747

(22) PCT Filed: Nov. 17, 2003

(86) PCT No.: PCT/JP03/14590

§ 371 (c)(1),
(2), (4) Date: May 20, 2005

(87) PCT Pub. No.: WO2004/046445

PCT Pub. Date: Jun. 3, 2004

(65) Prior Publication Data

US 2006/0011116 A1 Jan. 19, 2006

(30) Foreign Application Priority Data

Nov. 21, 2002 (JP) ..... 2002-338484

(51) Int. Cl.
*D05B 3/12* (2006.01)

(52) U.S. Cl. ..... 112/99; 112/113

(58) Field of Classification Search ..... 112/88, 112/98, 99, 104, 110, 113, 114, 115
See application file for complete search history.

(56) References Cited

U.S. PATENT DOCUMENTS

| | | | | | |
|---|---|---|---|---|---|
| 700,305 | A | * | 5/1902 | Cornely | 112/99 |
| 3,390,650 | A | * | 7/1968 | Ochsner | 112/88 |
| 4,848,253 | A | * | 7/1989 | Tajima | 112/99 |
| 5,481,993 | A | * | 1/1996 | Kurihara | 112/475.01 |
| 5,562,057 | A | * | 10/1996 | Lenson | 112/88 |
| 5,755,168 | A | | 5/1998 | Gunther et al. | |

FOREIGN PATENT DOCUMENTS

| | | |
|---|---|---|
| DE | 16 85 142 | 3/1972 |
| DE | 92 09 764 | 10/1992 |
| DE | 44 18 384 A1 | 12/1994 |
| EP | 1 209 272 A1 | 5/2002 |
| JP | 2-13495 A | 1/1990 |
| JP | 7-862 B2 | 1/1995 |
| JP | 2732869 B2 | 12/1997 |

* cited by examiner

*Primary Examiner*—Ismael Izaguirre
(74) *Attorney, Agent, or Firm*—Rossi, Kimms & McDowell, LLP

(57) ABSTRACT

Sequin feeding operation is performed by causing a feed lever (18) to move forward with a distal-end hook portion (18*a*) of the feed lever engaging a sequin center hole (3*a*) of a continuous sequin strip (3) let out from a reel (5) and then placed on the upper surface of a supporting plate (8), and the successive sequins can be fed one by one by repeating forward and rearward movement of the feed lever. Lock lever (33) having an engaging claw (33*a*) engageable with the sequin center hole is pivotably supported near the feed lever. When predetermined-pitch feeding, by the feed lever, of the continuous sequin strip has been completed, the engaging claw (33*a*) of the lock lever is caused to engage a center hole following the center hole engaged by the hook portion of the feed lever, to thereby immovably lock the continuous sequin strip.

8 Claims, 9 Drawing Sheets

SEQUIN FEEDER

This application is a U.S. National Phase Application of PCT International Application PCT/JP2003/014590.

TECHNICAL FIELD

The present invention relates to a sequin feeding apparatus for use in a sewing machine which sews sequins onto a sewn-to member while severing the sequins from a strip of continuously-connected sequins.

BACKGROUND ART

Example of the conventional sequin feeding apparatus for use in sewing machines is known from German Utility Model Registration No. G9209764.2 or U.S. Pat. No. 5,755,168 (German Patent No. DE19538084). In such a sequin feeding apparatus, a strip of a multiplicity of continuously-connected sequins (spangles) is played out or let out from a reel, having the continuous sequin strip wound thereon, to be placed on a supporting plate, and then the continuous sequin strip is fed out, through feeding operation of a suitable feed mechanism, at a predetermined pitch corresponding to the size of one sequin. One sequin is sewn onto a sewn-to member while being severed from the continuous sequin strip having been fed in interlocked relation to sewing operation by a needle bar of the sewing machine. With the above-discussed conventional sequin feeding apparatus, there has been a need to provide, on the supporting plate, an appropriate guide member for guiding the continuous sequin strip at a predetermined position so that the center hole of the sequin is positioned in accurate alignment with the needle bar.

Japanese Patent Publication No. HEI-2-13495 or Japanese Patent No. 2732869 discloses a mechanism for feeding a continuous sequin strip by means of a feed roller having a multiplicity of projection on it outer periphery. In this case, when a change is to be made to the size of the sequin, the feed roller too has to be replaced with another one corresponding to a new or changed-to sequin size; thus, there have to be prepared different feed rollers in correspondence with sequins of various sizes.

With the former one of the above-discussed two types of conventional techniques, the guide member has to be provided, on the supporting plate, to appropriately guide the continuous sequin strip and must be replaced in accordance with the size of the sequin, and the guide member replacing operation tends to be cumbersome. With the latter one of the conventional techniques too, different feed rollers have to be prepared in correspondence with sequins of various sizes, and the feed roller replacing operation tends to be cumbersome.

DISCLOSURE OF THE INVENTION

In view of the foregoing, it is an object of the present invention to provide a sequin feeding apparatus which can feed out a continuous sequin strip on a supporting plate in a stable manner with a simple structure.

The present invention provides a sequin feeding apparatus, which comprises: a feeding mechanism for feeding a continuous sequin strip, let out from a reel and then placed on an upper surface of a supporting plate, a predetermined pitch at a time through forward and rearward movement of a feed lever, the feeding mechanism feeding the continuous sequin strip by causing the feed lever to move forward with a distal-end hook portion of the feed lever engaging a center hole of a sequin; a lock lever having, at a free end thereof, an engaging claw engageable with the center hole of the sequin; and a lock lever drive mechanism pivotably supporting the lock lever near the feed lever, wherein, when predetermined-pitch feeding, by the feed lever, of the continuous sequin strip has been completed, the lock lever drive mechanism causes the engaging claw of the lock lever to engage a center hole following the center hole engaged by the hook portion of the feed lever, to thereby immovably lock the continuous sequin strip, and wherein, when the feed lever moves rearward and then moves forward to again feed the continuous sequin strip, the lock lever drive mechanism causes the engaging claw of the lock lever to be disengaged from the center hole by such a time when the hook portion of the feed lever engages a center hole of another sequin to resume feeding movement of the continuous sequin strip.

At the time point when the sequin strip has been fed out one pitch, the hook portion of the feed lever is engaging the center hole of a sequin and the engaging craw of the feed lever is engaging the center hole of another sequin succeeding the one engaged by the hook portion of the feed lever. In this way, the continuous sequin strip is appropriately locked in position at two separate positions along the length of the sequin strip. Thus, the continuous sequin strip on the supporting plate can be prevented from being displaced widthwise (laterally) during the feeding operation. Such arrangements can eliminate the need for provision of a sequin strip guide member on the supporting plate, thereby simplifying the construction of the apparatus. Further, because the continuous sequin strip is appropriately locked in position at two separate points along the length of the sequin strip, there can be achieved the benefit that, even when an unexpected tensile force acts on the sequin before the sequin is severed after the sewing needle has fitted in the center hole of the fed-out sequin, the continuous sequin strip can be prevented from being undesirably pulled out; as a consequence, the sequin can be cut in the connecting portion without fail, and thus, the sequin can be reliably prevented from being cut into a distorted shape.

BEST MODE FOR CARRYING OUT THE INVENTION

Figure 1:
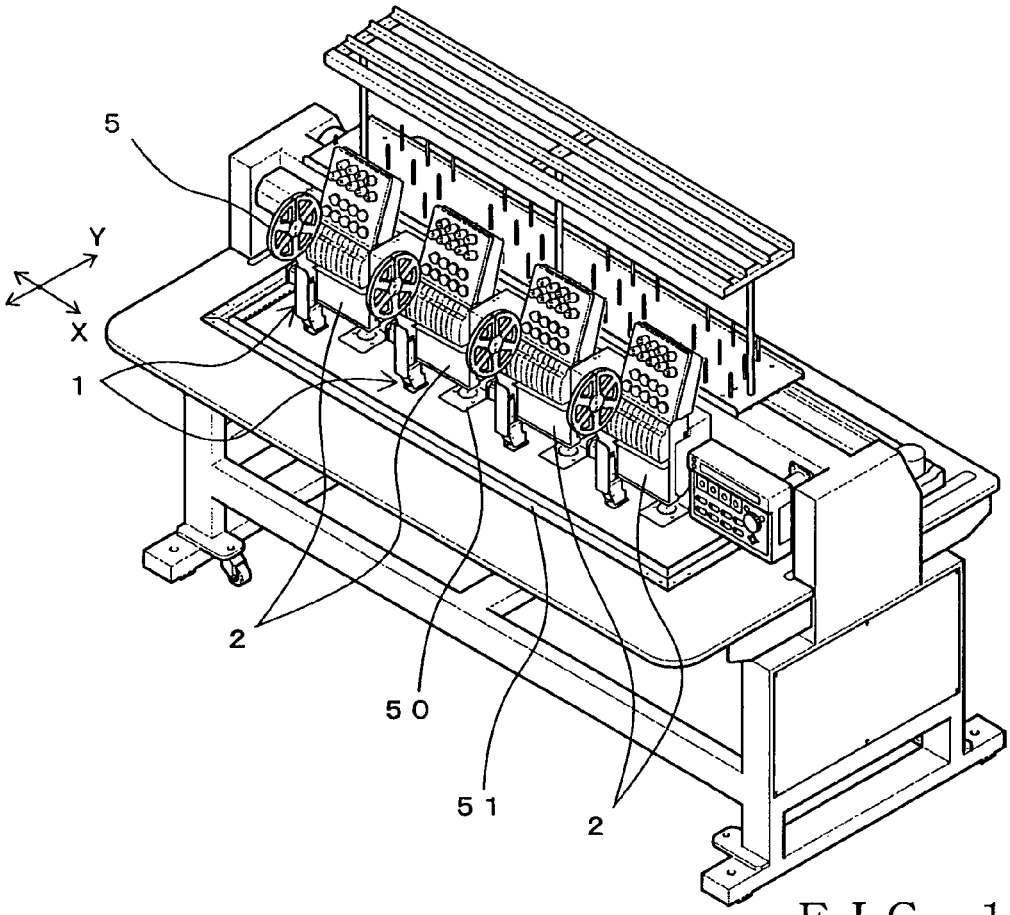
FIG. 1 is a perspective view showing an embodiment of an embroidering machine equipped with a sequin feeding apparatus in accordance with the present invention.

FIG. 1 shows a four-head embroidering machine equipped with four sewing machine heads arranged in accordance with an embodiment of the present invention. Needle bar cases 2 are provided in corresponding relation to the sewing machine heads, and a throat plate 50 is disposed under the needle bar of each of the machine head.

Sequin sewing unit 1 is attached to the left side and/or right side of each of the needle bar cases 2; in the instant embodiment, the sequin sewing unit 1 is attached to only the left side of the associated needle bar case 2. Each of the needle bar cases 2 is a multi-needle structure, and, in the case where the sequin sewing unit 1 is attached to only the left side of the associated needle bar case 2 as in the instant embodiment, the leftmost needle in the needle bar case 2 is used as a sequin sewing needle. As conventionally known in the art, an embroidery frame 51 is driven in left-and-right (X) and front-and-rear (Y) directions in accordance with sewing data.

Figure 5:
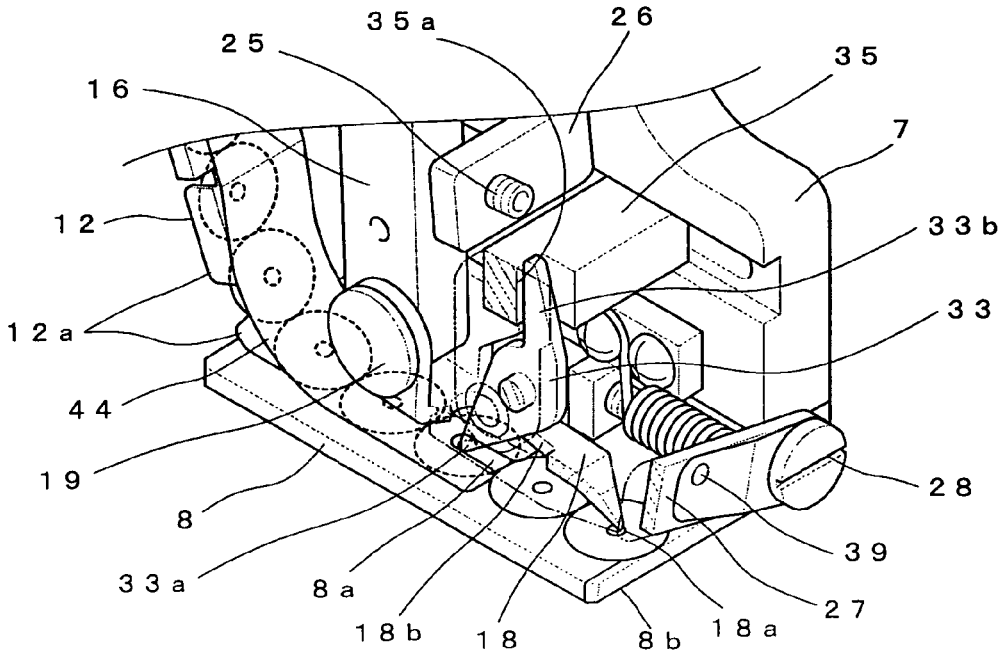
Figure 2:
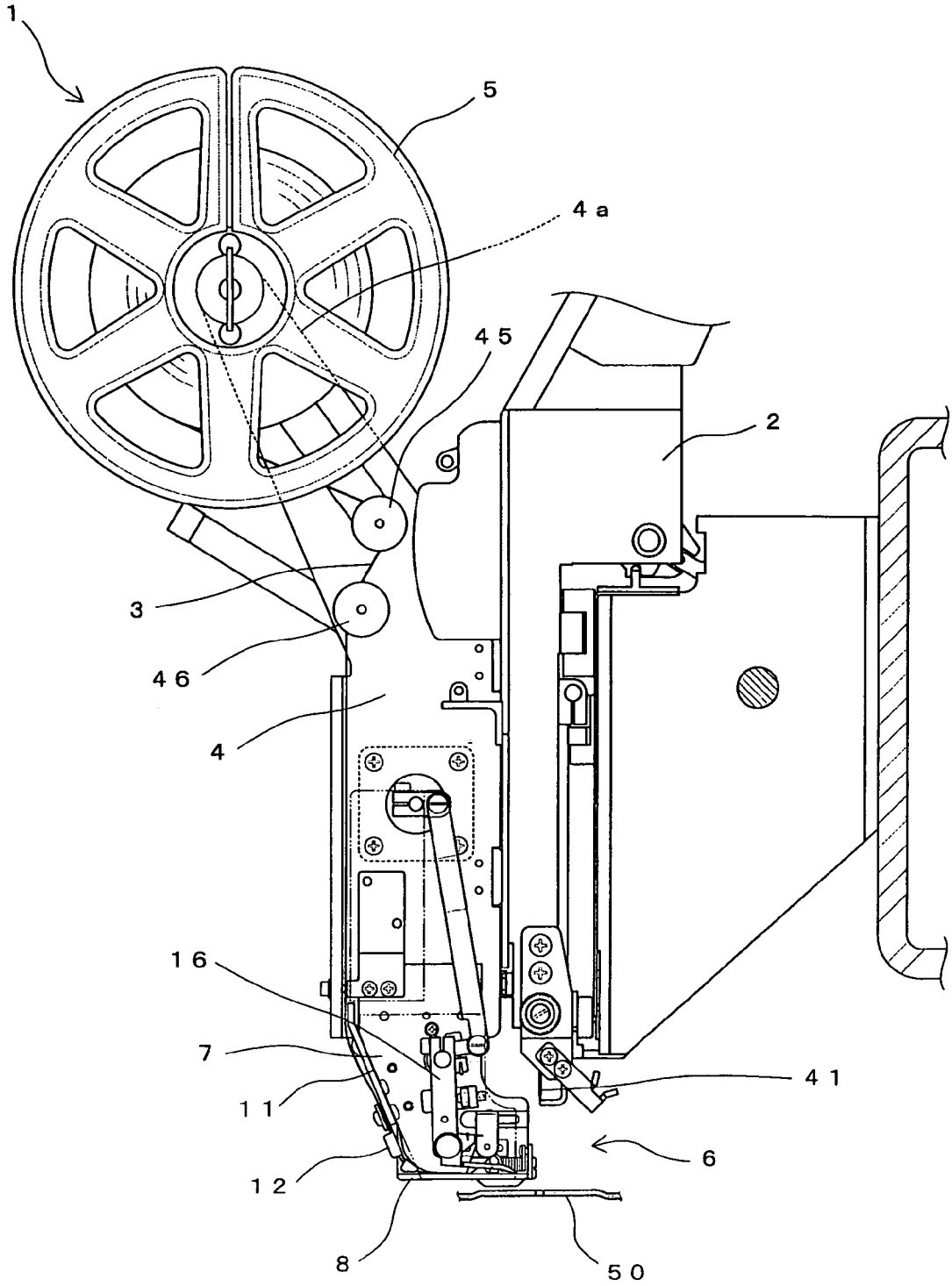
FIG. 2 is a side view showing in enlarged scale a portion of a sequin sewing unit in the embodiment.
Figure 3:
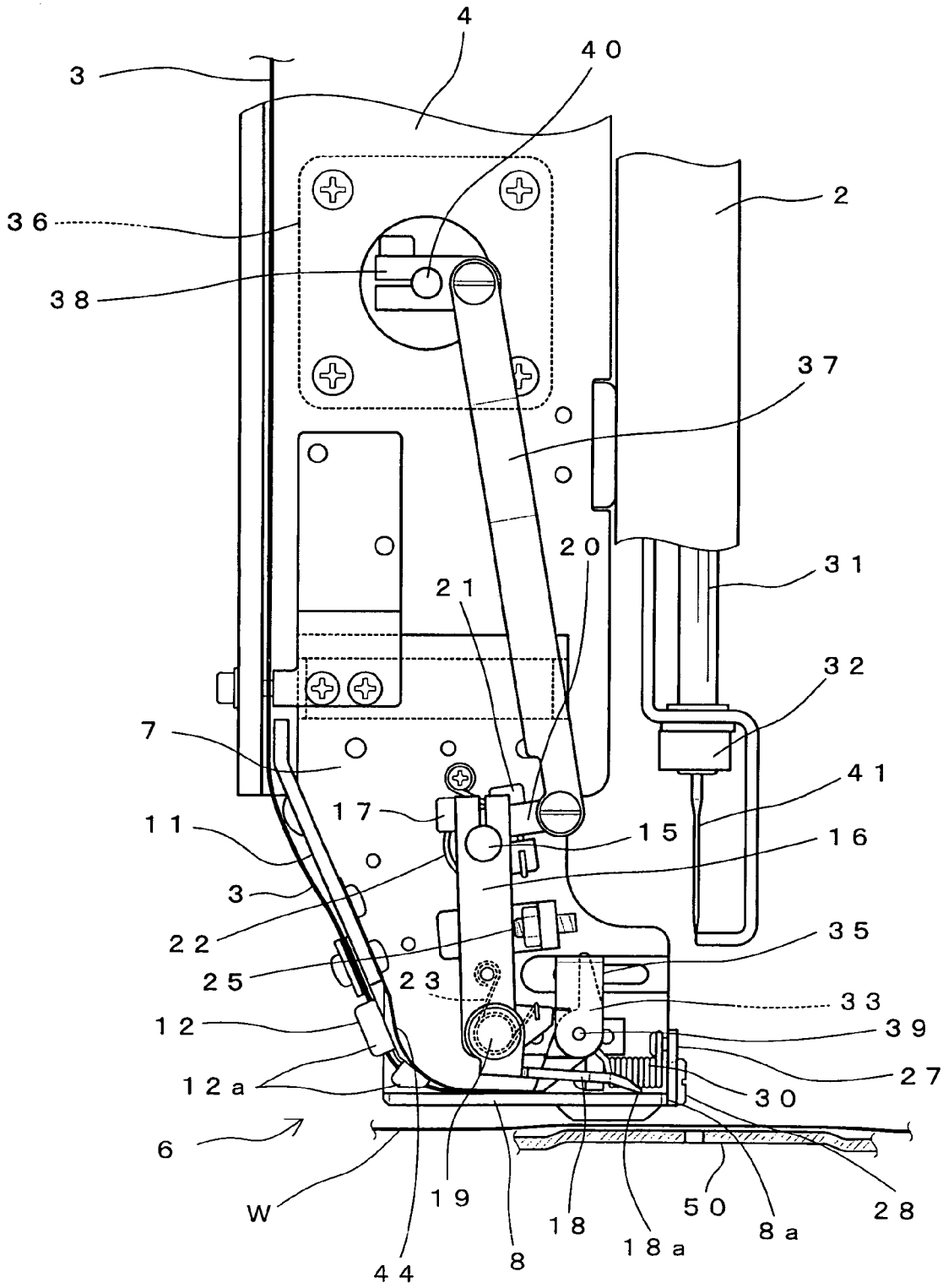
FIG. 3 is a side view showing in further enlarged scale a portion of the sequin sewing unit in the embodiment.
Figure 4:
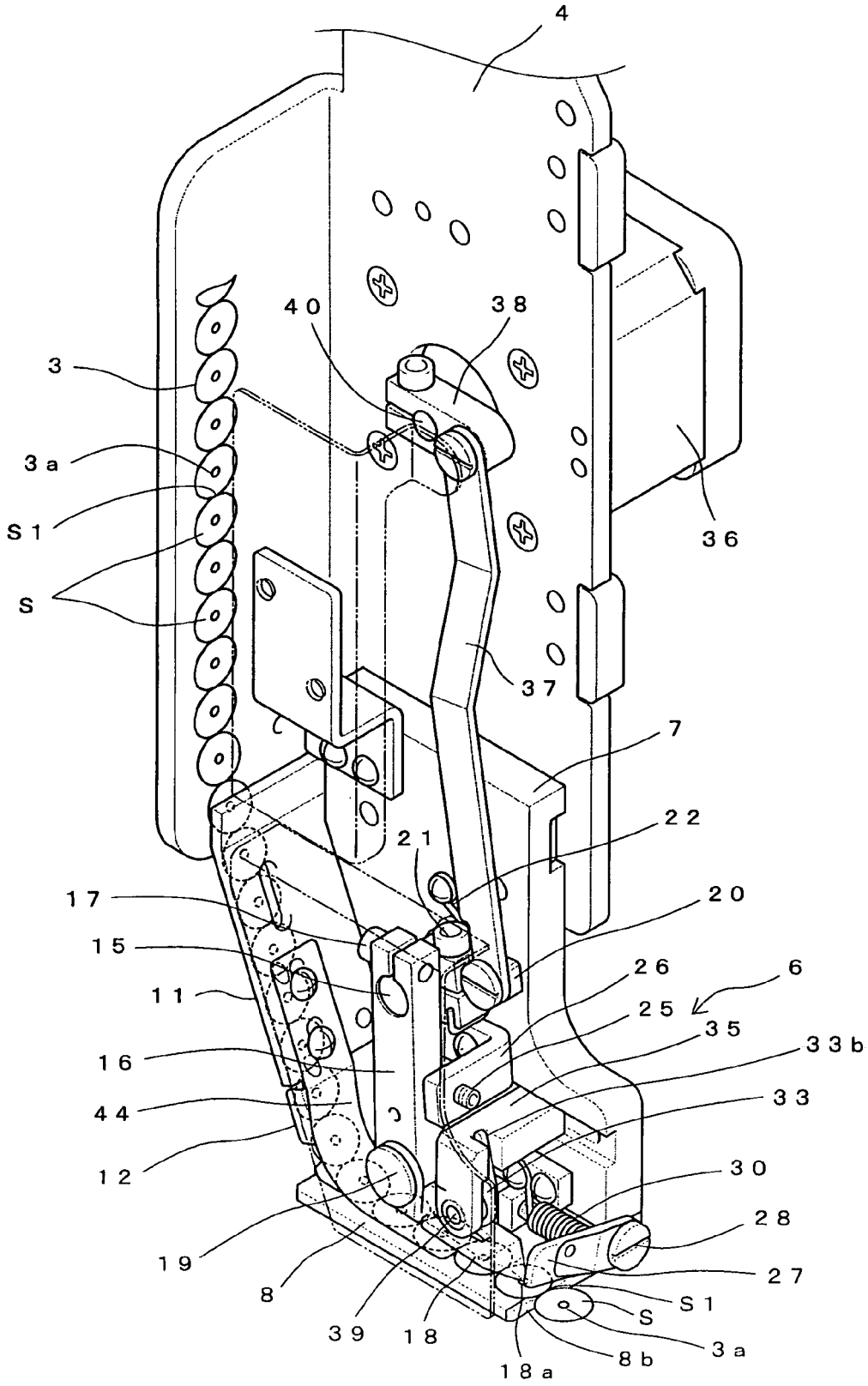
FIG. 4 is a perspective view of the portion of the sequin feeding apparatus shown in FIG. 3; and, FIG. 5 is a perspective view showing, in further enlarged scale and with parts taken away, principal sections of the sequin feeding apparatus shown in FIG. 4.

FIG. 2 is a side view showing in enlarged scale a portion of the sequin sewing unit 1, FIG. 3 is a side view showing in further enlarged scale a portion of a sequin feeding apparatus 6 in the sequin sewing unit 1, FIG. 4 is a perspective view of the portion of the sequin feeding apparatus 6, and FIG. 5 is a perspective view showing, in further enlarged scale and with parts taken away, principal sections of the sequin feeding apparatus 6.

As illustrated in FIG. 2, the sequin sewing unit 1 comprises a reel 5 having a strip of continuously-connected sequins wound thereon and supported on a mounting base 4, and the sequin feeding apparatus 6 also supported on the mounting base 4. The mounting base 4 is attached to the needle bar case 2 via a not-shown link mechanism in such a manner that it can ascend and descend relative to the needle bar case 2. In FIGS. 2 and 3, the mounting base 4 is shown as being in a descended position and in a posture where sewing of sequins is permitted. On the other hand, when sewing of sequins is not to be performed, the mounting base 4 is evacuated to an ascended position so as not to hinder the normal embroidering operation. In the individual machine heads, the mounting bases 4 are driven to ascend or descend concurrently via not-shown air cylinders. Where the embroidering machine has just one machine head or a smaller number of the machine heads, the mounting base (or bases) 4 may be caused to ascend or descend manually.

The reel 5 having the continuous sequin strip 3 wound thereon is supported rotatably and removably on an upper end portion of an arm section 4*a* formed on an upper portion of the mounting base 4. The continuous sequin strip 3 is formed by die-cutting a synthetic resin film of a given width in such a manner that a multiplicity of circular sequins S are continuously connected via narrow connecting portions S1, and each of the sequins S has a hole 3*a* formed in advance in its center (see FIG. 4).

Next, an example structure of the sequin feeding apparatus 6 will be explained in detail. The sequin feeding apparatus 6 is secured to a support plate 7 that is in turn attached to a lower end portion of the mounting base 4. The support plate 7 has a horizontal sequin supporting plate 8 formed on its lower end for supporting thereon sequins. Portion of the continuous sequin strip 3, paid out or let out from the reel 5, is directed downward along the mounting base 4 via a tension roller 45 and orientation roller 46, led onto the supporting plate 8 by way of a guide section 12 provided on a rear surface of a bracket 11 and then delivered rearward as viewed from the front of the embroidery machine. Note that, in the following description about the sequin sewing unit 1, the terms "forward" and "reward" are used to refer to directions opposite to forward and rearward directions of the embroidery machine. Namely, the direction in which sequins are fed forward (i.e., in a rearward direction from the front of the embroidery machine) will hereinafter referred to as "forward direction".

Figure 6:
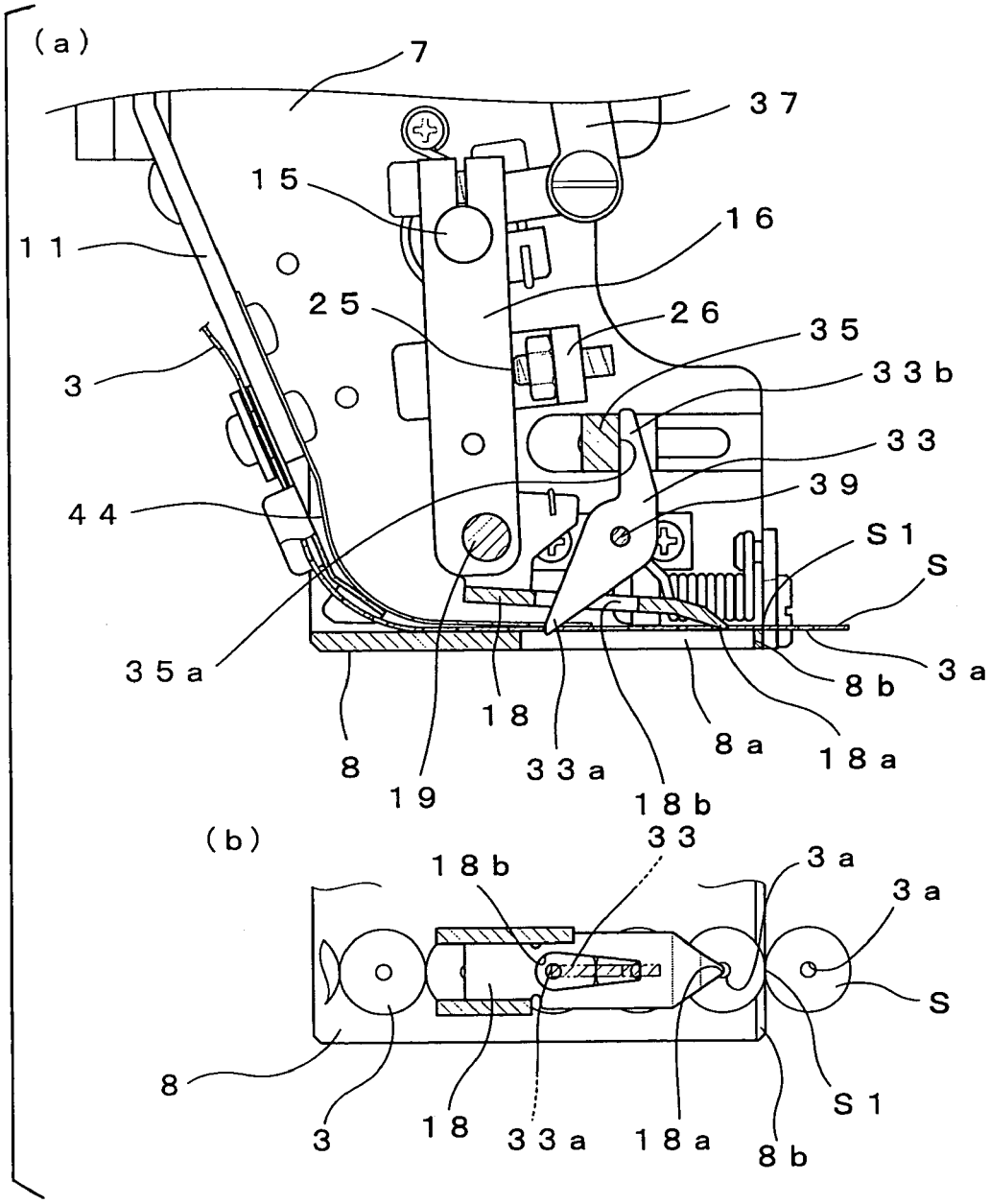
FIG. 6 is a partly-sectional side view and plan view showing the principal sections of the sequin feeding apparatus when one sequin feeding cycle has been completed by a feed lever having moved to its forwardmost position.

As seen in section (a) of FIG. 6, the sequin supporting plate 8 has a slit 8*a* formed therein to extend in the front-and-rear direction (Y direction) from a front position to a middle position of the plate 8. The slit 8*a* has a predetermined length and appropriate width. Adjusting the position, in the left-and-right direction (X direction), of the guide section 12 can properly position the center hole of each predetermined sequin 3 immediately over the slit 8*a*. Namely, in the present invention, the guide section 12 provided on the rear surface of the bracket 11 is provided for properly registering the center hole 3*a* of each predetermined sequin 3 of the continuous sequin strip 3 with the slit 8*a*, but not for properly positioning the continuous sequin strip on the supporting plate 8. As will be later described, the slit 8*a* of the sequin supporting plate 8 is provided to allow a distal-end hook portion 18*a* and distal-end engaging claw 33*a* of a feed lever 18 and lock lever 33 to pass through the center holes 3*a* of the sequins on the supporting plate 8 as the distal-end hook portion and engaging claw 18*a* and 33*a* engage with the center holes 3*a*.

As illustrated in FIG. 3 or 4, a pivot shaft 15 is pivotally supported on a middle portion of the support plate 7 with the axial centerline of the pivot shaft 15 extending in the left-and-right (X) direction. Pivot arm 16 is fixed via a screw 17 to the pivot shaft 15, and the feed lever 18 having the distal-end hook portion 18*a* is pivotably supported, via a shaft 19, on a free end portion of the pivot arm 16. Further, a follower lever 20 is fixed via a screw 21 to the pivot shaft 15 adjacent the pivot arm 16. Consequently, the follower lever 20 and pivot arm 16 are connected together to provide a bellcrank-like structure.

Torsion spring 22 fitted around the pivot shaft 15 has one end secured to the support plate 7 and the other end held on the follower lever 20, via which the pivot arm 16 is normally biased in a counterclockwise direction of FIG. 3. Further, a torsion spring 23 fitted around the shaft 19 has one end secured to the pivot art 16 and the other end held on the feed lever 18, via which the feed lever 18 is normally biased in a clockwise direction so that the distal-end hook portion 18*a* of the feed lever 18 is normally biased toward the supporting plate 8.

The feed lever 18 functions to sequentially feed the continuous sequin strip 3 in the forward direction, a predetermined pitch at a time, by being pivotally moved forward with the distal-end hook portion 18*a* engaging the center hole 3*a* of one sequin S of the strip 3 on the supporting plate 8. As will be later detailed, the feed lever 18 is pivotally moved forward and rearward by pivotal movement of the pivot arm 16, so as to sequentially feed the continuous sequin strip 3 forward at a predetermined pitch. The pivot arm 16 and mechanism for pivoting the pivot arm 16 together constitute a feed mechanism for pivotally moving the feed lever 18 forward and rearward. The follower lever 20 integrally connected with the pivot arm 16 has a free end connected to a free end of a driving lever 38 via a connection link 37. The driving lever 38 is fixedly connected to an output shaft 40 of a motor 36 that is secured to a left side surface of the mounting base 4. By the motor 36 driving the driving lever 38 to reciprocatively pivot through a predetermined angular range, the continuous sequin strip 3 can be fed forward in the predetermined manner.

The pivot art 16 normally biased in the counterclockwise direction is held in a posture as illustrated in FIGS. 3, 4 and 6 by abutting against a stopper 25 provided on the support plate 7. The illustrated posture is taken when the feeding of the continuous sequin strip 3 has been completed through one feeding cycle. Specifically, section (a) of FIG. 6 is a partly-sectional side view showing in enlarged scale of relevant portions of the sequin feeding apparatus 6 having completed the feeding of the continuous sequin strip 3, and section (b) of FIG. 6 is a schematic top plan view of the sequin feeding apparatus 6 having completed the feeding of the continuous sequin strip 3. Namely, when the feeding of the continuous sequin strip 3 has been completed, the hook portion 18*a* of the feeding lever 18 engages the center hole 3*a* of the second sequin S from the leading sequin of the continuous sequin strip 3, and the connecting portion S1 between the leading and second sequins S is positioned immediately above a fixed cutter blade 8*b* provided on a front end edge of the supporting plate 8.

The stopper 25 is in the form of a threaded rod screwed to a bracket 26 secured to the support plate 7, and the pivot arm 16 abuts against the rear end of the stopper 25. The threaded rod can be locked by screwing up of a nut.

Movable cutter blade 27 is pivotably supported via a pin 28 on a lower end portion of the support plate 7 and is normally held, via a torsion spring 30, in a retracted or evacuated position spaced upward from the fixed cutter blade 8*b*. As a needle bar 31 descends, the movable cutter blade 27 is pressed by a needle clamp 32 at the lower end of the needle bar 31. By being thus pressed by the needle clamp 32, the movable cutter blade 27 pivots downward, against the resilient force of the torsion spring 30, to cut the connecting portion S1 in conjunction with the fixed cutter blade 8*b*. As the needle clamp 32 ascends along with the needle bar 31, the movable cutter blade 27 returns to the retracted position by the resilient force of the torsion spring 30.

The above-mentioned guide section 12 for directing the continuous sequin strip 3 onto the supporting plate 8 is replaceable with another one depending on the width of the desired continuous sequin strip 3. The guide section 12 comprises two guide members 12*a*, each of which may be made by bending a plate into a channel-like sectional shape. Distance between opposed side walls of each of the guide members 12*a* is set slightly greater than the width of each sequin S. Holding member 44 is disposed in front of the bracket 11 having the guide section 12 attached thereto. The holding member 44 is in the form of a resilient plate, such as a spring steel plate, which has a width equal to or slightly greater than the width of the sequin S and has a predetermined length. The holding member 44 has one end portion secured to the bracket 11 and another end portion resiliently abutted against the upper surface of the supporting plate 8. The holding member 44 is recessed in its end edge portion corresponding in position to the slit 8*a*, so as not to close the slit 8*a* (see FIG. 5). The continuous sequin strip 3, delivered from the guide section 12, is passed between the supporting plate 8 and the holding member 44 resiliently abutted against the upper surface of the supporting plate 8.

Next, a description will be given about the lock lever 33 disposed above the feed lever 18 and a mechanism for driving the lock lever 33.

As seen in FIG. 5, the lock lever 33 has the engaging claw 33*a* at the tip of its one end portion and a stopper portion 33*b* at its other end portion. The lock lever 33 is pivotably supported at its middle portion by a support block 35 via a pin 39, and the support block 35 is fixed to the support plate 7. In FIG. 5, a front portion of the support block 35 is taken away so that the lock lever 33 is visible more easily. The engaging claw 33*a* of the lock lever 33 extends through a through-hole 18*b* formed in the feed lever 18. Torsion spring (not shown) is provided on the pin 39 on the support block 35, and the lock lever 33 is normally biased, by that torsion spring, against the support block 35 in a counterclockwise direction of the figure. With the stopper portion 33*b* of the thus-biased lock lever 33 abutting against a stopper portion 35*a* of the support block 35, the lock lever 33 in its free state is held in a posture or position where an end edge of the stopper portion 33*b* is located within the slit 8*a* of the supporting plate 8. In this state, the engaging claw 33*a* of the lock lever 33 engages the center hole 3*a* of the sequin S on the supporting plate 8, as illustrated in (b) of FIG. 6, to thereby lock the continuous sequin strip 3 against further movement. On the other hand, an edge of the through-hole 18*b* in the feed lever 18 abuts against the lock lever 33, during retracting movement of the feed lever 8, to pivot the lock lever 33 in the clockwise direction against the counterclockwise biasing force of the torsion spring acting on the lock lever 33, as will be later described. In this way, the engaging claw 33*a* is pivoted upwardly to disengage the center hole 3*a* of the sequin S.

The support block 35 supporting the lock lever 33 is adjustable in its position, in the front-and-rear direction (feeding direction of the continuous sequin strip 3 on the supporting plate 8), relative to the support plate 7. Thus, the position at which the engaging claw 33*a* of the lock lever 33 engages the center hole 3*a* of the sequin S can be adjusted in accordance with the size of the sequin S. Note that the support plate 7 too is adjustable in its position, in the front-and-rear direction (feeding direction of the continuous sequin strip 3 on the supporting plate 8), relative to the mounting base 4.

In the embodiment of the embroidery machine, the needle bar case 2 of each of the machine head is provided with nine needles 31, and the sequin sewing unit 1 is attached to the left side of each of the needle bar cases 2 as noted above. In executing the sequin sewing operation, the sequin sewing unit 1 descends to take an operating state, in response to selection of the leftmost needle bar 31, to execute sequin sewing in conjunction with the needle bar 31.

The following paragraphs describe the sequin feeding operation in accordance with the embodiment of the present invention, with reference to FIGS. 6–10.

FIG. 6 shows a state when one sequin feeding operation cycle has been completed. As noted above, one sequin S is projecting forward from the supporting plate 8, and the connecting portion S1 of the one sequin is in alignment with the edge of the cutter blade 8*b*. As also noted earlier, the hook portion 18*a* of the feed lever 18 is in engagement with the center hole 3*a* of the next sequin S, and the engaging claw 33*a* of the lock lever 33 is in engagement with the center hole 3*a* of the second sequin S from the sequin S engaged by the hook portion 18*a*.

The machine behaves as follows by virtue of operation of the needle bar 31 descending under such conditions.

First, the sewing needle 41 at the lower end of the needle bar 31 fits into the center hole 3*a* of the leading sequin S. Then, the needle clamp 32 abuts against and depresses the movable cutter blade 27. Thus, the connecting portion S1 of the sequin S is cut by the blade 27, so that the leading sequin S is cut off. Thus, the one sequin S thus cut off falls onto a to-be-embroidered cloth W (FIG. 3) with the sewing needle 41 still kept fit in the center hole 3*a*, after which the sequin S is sewn onto the cloth W through controlled movement of the embroidery frame holding the to-be-embroidered cloth W and vertical movement of the needle bar.

Figure 7:
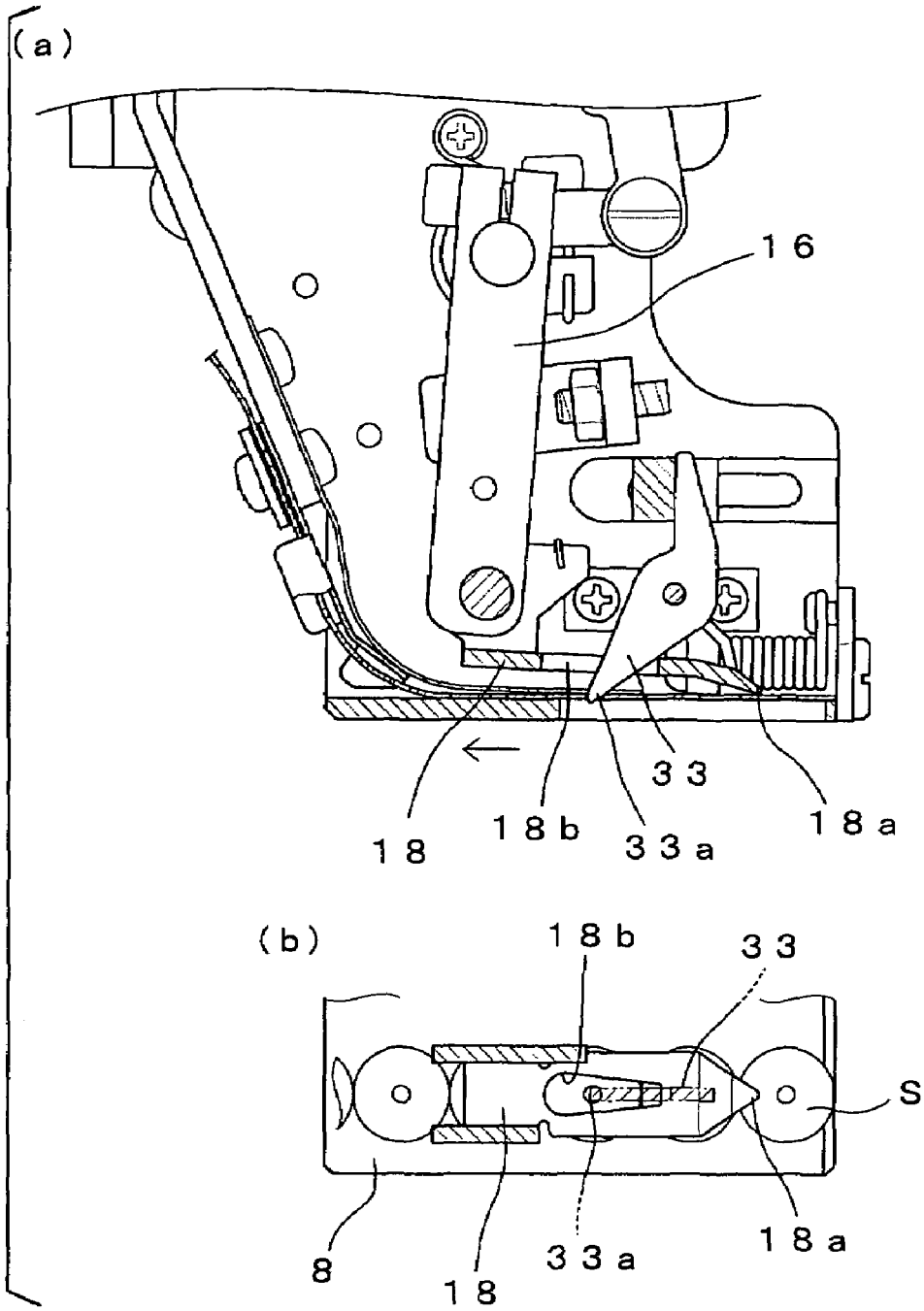
FIG. 7 is a partly-sectional side view and plan view showing the principal sections of the sequin feeding apparatus immediately after a hook portion of the feed lever has exited a center hole of a sequin during rearward movement of the feed lever.
Figure 8:
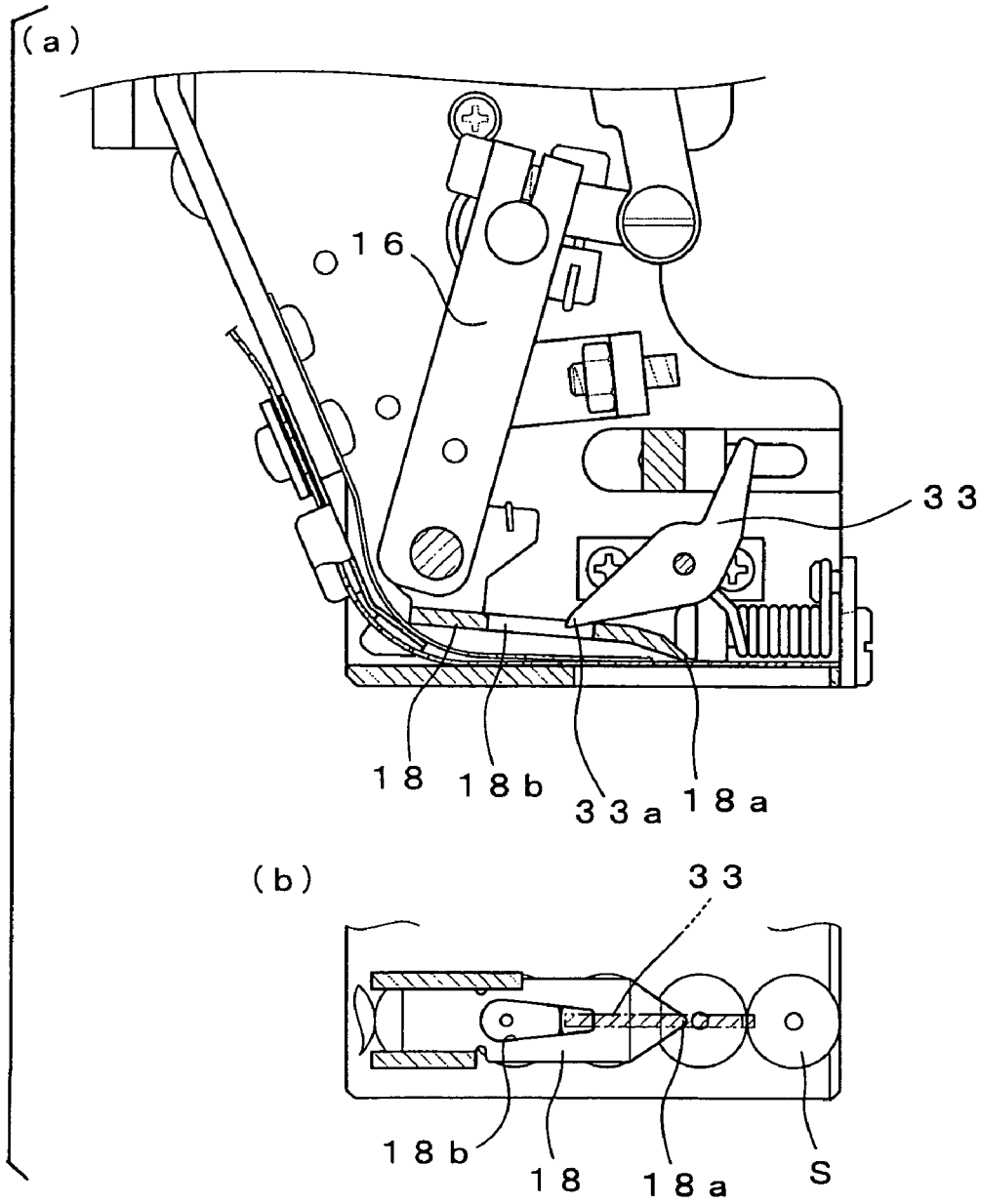
FIG. 8 is a partly-sectional side view and plan view showing the principal sections of the sequin feeding apparatus when the feed lever has moved to a rearwardmost position.

Then, the pivot arm 16 is pivoted in the clockwise direction via the motor 36, so that the feed lever 18 moves backward as seen in FIGS. 7 and 8. FIG. 7 shows the feed lever 18 immediately after the hook portion 18*a* has exited from the center hole 3*a*; more specifically, section (a) of FIG. 7 is a partly-sectional side view of the feed lever 18, and section (b) of FIG. 7 is a schematic top plan view of the feed lever 18. Because the engaging claw 33*a* of the lock lever 33 is still kept in engagement with the center hole 3*a* when the hook portion 18*a* exits from the center hole 3*a*, the continuous sequin strip 3 can be reliably prevented from being undesirably displaced as the hook portion 18*a* of the feed lever 18 exits from the center hole 3*a*. Further, in the state illustrated in FIG. 7, the edge of the through-hole 18*b* of the feed lever 18 abuts against the lock lever 33. As the feed lever 18 retracts further, the lock lever 33 pivots in the clockwise direction, against the biasing force of the torsion spring, through the engagement with the edge of the through-hole 18*b* of the feed lever 18, so that the engaging claw 33*a* of the lock lever 33 moves upward away from the sequin S; in this way, the center hole 3*a* of the sequin S is disengaged from the engaging claw 33*a*.

FIG. 8 shows the lever 18 having retracted to its rearwardmost position; more specifically, section (a) of FIG. 8 is a partly-sectional side view of the lever 18, and section (b) of FIG. 8 is a top plan view of the lever 18. Immediately before the state of FIG. 8 is reached, the hook portion 18*a* of the feed lever 18 temporarily fits into the center hole 3*a* of the sequin S and then exits from the center hole 3*a*; after that, the feed lever 18 assumes the state of FIG. 8. Note that, the continuous sequin strip 3, having been disengaged from the engaging claw 33*a* of the lock lever 33, is prevented from retracting together with the retracting feed lever 18 during a transitional period from the state of FIG. 7 to the state of FIG. 8; this is owing to the springy resilient force of the holding member 44.

Figure 9:
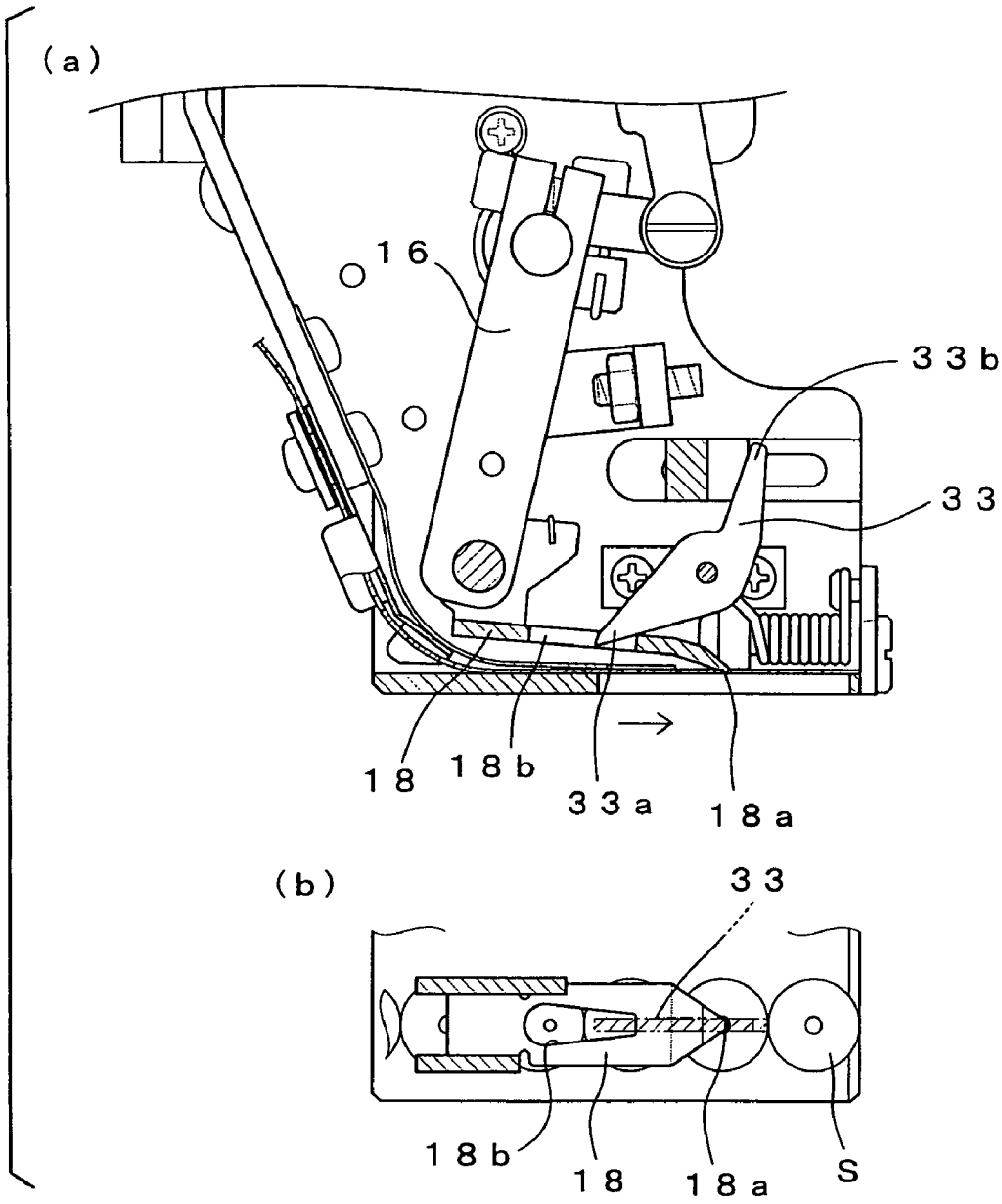
FIG. 9 is a partly-sectional side view and plan view showing the principal sections of the sequin feeding apparatus at a time point when the hook portion of the feed lever has engaged a center hole of a sequin during forward movement of the feed lever.
Figure 10:
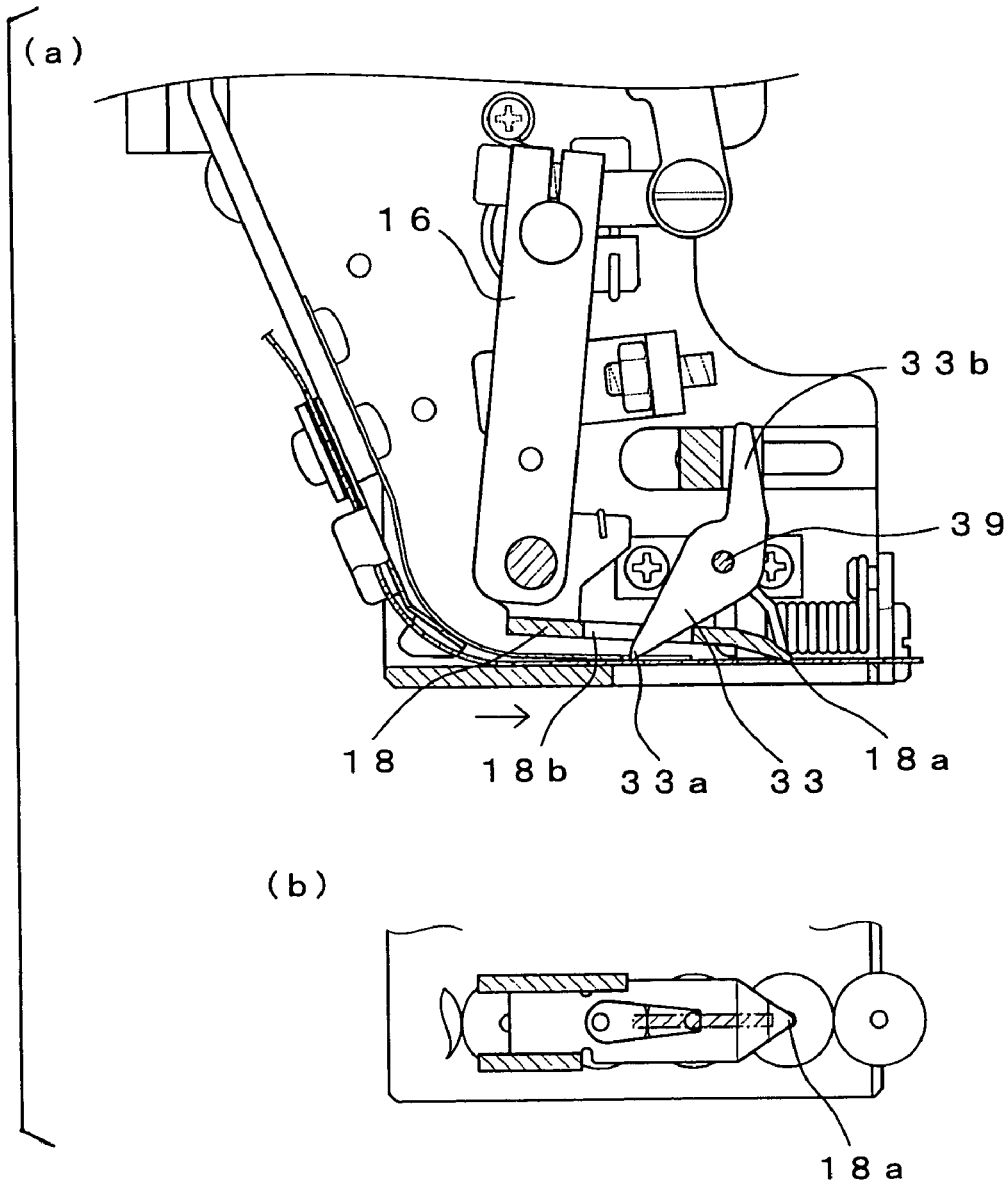
FIG. 10 is a partly-sectional side view and plan view showing the principal sections of the sequin feeding apparatus at a time point when an edge of a through-hole of the feed lever is just about to move away from a lock lever.

After that, the pivot lever 16 is driven, by the reverse rotation of the motor 36, to pivot in the counterclockwise direction, so that the feed lever 18 moves forward to the position shown in FIGS. 6. FIGS. 9 and 10 shows a state of the feed lever 18 during such forward movement. FIG. 9 shows the lever 18 at a time point when the hook portion 18*a* has engaged the center hole 3*a* of the sequin S through the forward movement of the feed lever 18; more specifically, section (a) of FIG. 9 is a partly-sectional side view of the lever 18, and section (b) of FIG. 9 is a plan view of the lever 18. As the feed lever 18 moves forward after that time point, the continuous sequin strip 3 is fed through forward movement of the hook portion 18*a* engaging the center hole 3*a*. FIG. 10 shows the lock lever 18 at a point when the edge of the through-hole 18*b* of the advancing feed lever 18 moves away from the lock lever 33; more specifically, section (a) of FIG. 10 is a partly-sectional side view of the lever 18, and section (b) of FIG. 10 is a plan view of the lever 18. Having been disengaged from the edge of the through-hole 18*b* of the feed lever 18, the lock lever 33 is caused to pivot in the counterclockwise direction by the resilient force of the torsion spring provided on the pin 39. FIG. 10 shows the engaging claw 33*a* of the lock lever 33 having been thus brought into resilient contact with the upper surface of the sequin S. While the feed lever 18 is advancing further, the engaging claw 33*a* of the lock lever 33 slides on and relative to the upper surface of the sequin S. Once the feed lever 18 has reached the feed completion position as shown in FIG. 6, the engaging claw 33*a* of the lock lever 33 engages the center hole 3*a* of the sequin S.

When the motor 36 is in the non-energized or OFF state, such as when the power supply to the embroidering machine is OFF, the pivot lever 16 is held in the feed completion position shown in FIG. 6, by virtue of the resilient force of the torsion spring 22 on the pivot lever 16, so that the lever 16 is held in abutment against the stopper 25. The motor 36 is a pulse motor that operates under open control, so that it will lose appropriate synchronization if an excessive force acts on the motor 36 during the feed control. For that reason, the motor 36 in the embodiment is temporarily deenergized when the feed lever 18 has reached the forwardmost position, i.e. when the pivot lever 16 has abutted against the stopper 25 upon completion of the feeding cycle. Thus, the motor 36 can be restored to the zero point without fail even when it has lost synchronization; in this way, it is possible to prevent accumulation of positional displacement caused by the synchronization loss.

Finally, the following paragraphs describe an example manner in which the various components are adjusted when the reel 5 has been replaced with another one so that the sequins S to be sewn onto the cloth are changed to those of a different size. The adjustments of the components, as set forth in items (1)–(4) below, may be performed concurrently, or in any appropriate order.

(1) Adjustment of Feed Pitch:

In order to adjust the feed pitch, the screw 17 fastening the pivot lever 16 is loosened (see FIGS. 3 and 4) so that the pivot lever 16 can be readily turned with a hand relative to the pivot shaft 15. Further, the stopper 25 is unlocked, and the continuous sequin strip 3 is played out from the reel onto the supporting plate 8 so that the leading sequin S of the strip 3 projects beyond the front end edge of the supporting plate 8 as in the "feed completion position" as shown in (b) of FIG. 6. Then, the pivot lever 16 and feed lever 18 are moved with a hand to cause the hook portion 18*a* of the feed lever 18 to engage the center hole 3*a* of the second sequin S from the leading sequin S. Then, the stopper 25 is again locked and the screw 17 is tightened with the feed mechanism, including the pivot lever 16 and feed lever 18, adjusted into the "feed completion position" in accordance with the size of the sequins S.

(2) Adjustment of Lock Lever:

To adjust the lock lever 33, the support block 35 is unlocked. Position, in the front-and-rear direction, of the support block 35 is adjusted manually to adjust the inclination of the lock lever 33 so that the engaging claw 33*a* of the lock lever 33 engages the center hole 3*a* of the predetermined sequin S (i.e., second sequin S from the sequin S of which the center hole 3*a* has been engaged by the hook portion 18*a* of the feed lever 18) with the stopper portion

33*b* at the upper end of the lock lever 33 abutted against the stopper portion 35*a* of the support block 35, as illustrated in FIG. 6. Then, the support block 35 is again locked with the lock lever 33 positionally adjusted so that the engaging claw 33*a* of the lock lever 33 engages the center hole 3*a* of the predetermined sequin S as indicated by the "feed completion position" of FIG. 6 (*b*).

(3) Positional Adjustment of Sequin Center Hole Relative to Sewing Needle Position:

Positional adjustment between the sewing needle 41 and the center hole 3*a* of the sequin S is performed by adjusting the position of the support plate 7 relative to the mounting base 4. Because the support plate 7 is mounted on the mounting base 4 via the forward/rearward guide members, a lock (not shown) provided in connection with the guide members is first brought into an unlocking position, so as to allow the support plate 7 to be manually moved in the front-and-rear direction relative to the mounting base 4. Then, the support plate 7 is adjusted so that the center of the center hole 3*a* of the sequin S, having been delivered from the supporting plate 8 to a position where the connecting portion S1 aligns with the edge of the cutter blade 8*b*, aligns with the center of the sewing needle 41. Upon completion of the adjustment, the support plate 7 is locked and fixed to the mounting base 4.

(4) Replacement of Guide Section:

As necessary, the guide section 12, mounted on the bracket 11, may be replaced with another one that corresponds to the width of the sequins of a continuous sequin strip newly set on the apparatus in place of the previous sequin strip.

In the above-described embodiment, the motor 36 is disposed in an upper area of the apparatus and the pivot lever 16 is driven by the motor 36 via the link mechanism. In an alternative, the pivot lever 16 may be driven directly by the output shaft 40 of the motor 36. Namely, in the alternative, the pivot shaft 15 and follower lever 20 are dispensed with, the motor 36 is fixed to the support plate 7, and the pivot lever 16 is secured to the output shaft 40 of the motor 36.

Furthermore, whereas the above-described embodiment is arranged in such a manner that, during the rearward movement of the feed lever 18, the locking by the lock lever 33 is cancelled after the timing of FIG. 7. However, the present invention is not so limited, and it is only necessary that the locking by the lock lever 33 be cancelled at least before the timing of FIG. 8 (i.e., before the feed lever 18 resumes its forward movement). In the case where arrangements are made such that the lock lever 33 is kept in the locking position until the timing of FIG. 8 (i.e., until the feed lever 18 resumes its forward movement), the separate holding member 44 may be dispensed with.

Furthermore, in the above-described embodiment, the lock lever 33 is pivoted in the counterclockwise direction by the biasing force of the torsion spring provided on the pin 39 of the support block 36 and pivoted in the clockwise direction by the engagement between the edge of the through-hole 18*b* of the retracting feed lever 18 and the lock lever 33. However, the present invention is not so limited, and any other suitable arrangements may be employed. For example, the spring employed as the biasing means may be other than the torsion spring, and the biasing means may include an electric or electronic or mechanical drive means other than the spring.

According to the described embodiment, the engaging claw 33*a* of the lock lever 33 engages the center hole 3*a* of the sequin S at a time point when the feeding-out of the leading sequin has been completed. Thus, even when an unexpected tensile force acts on the sequin S before the sequin S is severed after the sewing needle 41 has fitted in the center hole 3*a* of the fed-out sequin S, the continuous sequin strip 3 can be prevented from being undesirably pulled out; as a consequence, the sequin S can be cut in the connecting portion S1 without fail, and thus, the sequin S is reliably prevented from being cut into a distorted shape.

Further, at the time point when the feeding-out of the leading sequin has been completed, the hook portion 18*a* of the feed lever 18 and the engaging claw 33*a* of the lock lever 33 both engage the center holes 3*a* of the predetermined sequins S, so that the continuous sequin strip 3 can be positionally regulated at separate points thereof in its longitudinal direction (i.e., feeing direction). As a consequence, the sequin S can be positionally adjusted in its widthwise direction at least upon completion of each sequin feeding cycle. Therefore, there is no need to provide a particular guide member on the supporting plate 8 for positionally regulating the continuous sequin strip 3.

According to the present invention, as set forth above, the engaging claw of the lock lever engages a sequin center hole following a sequin center hole engaged by the hook portion of the feed lever, to thereby immovably lock the continuous sequin strip in such a manner that the continuous sequin strip can be locked in position at two separate points in its longitudinal direction. With such arrangements, the present invention achieves the superior benefits that the continuous sequin strip can be reliably positioned on the supporting plate with a simple construction. Further, because the continuous sequin strip can be locked in position at two separate points in its longitudinal direction, there can be achieved another superior benefit that, even when an unexpected tensile force acts on the sequin before the sequin is severed after the sewing needle has fitted in the center hole of the fed-out sequin, the continuous sequin strip can be prevented from being undesirably pulled out; as a consequence, the sequin can be cut in the connecting portion without fail, and thus, the sequin is reliably prevented from being cut into a distorted shape.

What is claimed is:

1. A sequin feeding apparatus comprising:

a feeding mechanism for feeding a continuous sequin strip, let out from a reel and then placed on an upper surface of a supporting plate, a predetermined pitch at a time through forward and rearward movement of a feed lever, said feeding mechanism feeding the continuous sequin strip by causing said feed lever to move forward with a distal-end hook portion of said feed lever engaging a hole of a sequin;

a lock lever having an engaging claw engageable with a hole of a sequin; and a lock lever drive mechanism pivotably supporting said lock lever near said feed lever, wherein, when predetermined-pitch feeding, by said feed lever, of the continuous sequin strip has been completed, said lock lever drive mechanism causes the engaging claw of said lock lever to engage a hole of another sequin of the continuous sequin strip than the sequin engaged by the hook portion of said feed lever, to thereby immovably lock the continuous sequin strip, and when said feed lever should then resume the predetermined-pitch feeding, said lock lever drive mechanism causes the engaging claw of said lock lever to be disengaged from the hole, so as to permit movement of the continuous sequin strip.

2. A sequin feeding apparatus as claimed in claim 1 wherein said lock lever drive mechanism includes means for normally biasing said lock lever so that the engaging claw resiliently contacts an upper surface of a sequin on the supporting plate, and wherein disengagement of the engaging claw of said lock lever from the hole of the sequin is carried out by said feed lever engaging with said lock lever to move the engaging claw, against a biasing force of said biasing means, as said feed lever moves rearward.

3. A sequin feeding apparatus as claimed in claim 1 wherein said feeding mechanism supports said feed lever pivotably relative to a pivot arm that is driven to pivot by a motor, and said feed lever is normally biased in a direction where the distal-end hook portion resiliently contacts an upper surface of a sequin on the supporting plate.

4. A sequin feeding apparatus as claimed in claim 3 wherein said feed lever is normally biased by a spring in a feeding direction thereof, and an output shaft of the motor is placed in a freely-rotatable state after completion of a feeding cycle.

5. A sequin feeding apparatus as claimed in claim 3 wherein said pivot arm is driven via a link member coupled to an output shaft of the motor.

6. A sequin feeding apparatus as claimed in claim 2 wherein said feeding mechanism supports said feed lever pivotably relative to a pivot arm that is driven to pivot by a motor, and said feed lever is normally biased in a direction where the distal-end hook portion resiliently contacts an upper surface of a sequin on the supporting plate.

7. A sequin feeding apparatus as claimed in claim 6 wherein said feed lever is normally biased by a spring in a feeding direction thereof, and an output shaft of said motor is placed in a freely-rotatable state upon completion of a feeding operation cycle.

8. A sequin feeding apparatus as claimed in claim 6 wherein said pivot arm is driven via a link member coupled to an output shaft of the motor.

* * * * *